United States Patent [19]

Naruse et al.

[11] Patent Number: 5,056,983

[45] Date of Patent: Oct. 15, 1991

[54] LOAD HANDLING CONTROL APPARATUS FOR A FORK LIFT TRUCK

[75] Inventors: Yasuhiko Naruse; Masanao Kobayakawa, both of Kariya, Japan

[73] Assignee: Kabushiki Kaisha Toyoda Jidoshokki Seisakusho, Kariya, Japan

[21] Appl. No.: 505,886

[22] Filed: Apr. 5, 1990

[30] Foreign Application Priority Data

Apr. 13, 1989 [JP] Japan ..... 1-43470

[51] Int. Cl.[5] ..... B66F 9/22; G05G 5/18

[52] U.S. Cl. ..... 414/635; 74/491; 74/525

[58] Field of Search ..... 414/628–638, 414/661; 74/522, 525, 491

[56] References Cited

U.S. PATENT DOCUMENTS

| | | | |
|---|---|---|---|
| 1,769,566 | 7/1930 | Goodrich | 74/525 X |
| 1,987,066 | 1/1935 | Kingston | 74/525 X |
| 2,427,310 | 9/1947 | Shumaker | 74/522 X |
| 3,005,562 | 10/1961 | Shaffer | 414/635 |
| 3,014,344 | 12/1961 | Arnot | 414/635 X |
| 3,633,435 | 1/1972 | Farr | 74/522 X |
| 3,736,800 | 6/1973 | Gregory | 74/525 X |
| 3,866,418 | 2/1975 | Waters | 60/420 |
| 3,962,871 | 6/1976 | Blaha et al. | 60/433 |
| 3,965,771 | 6/1976 | MacDonald | 74/479 |
| 4,299,137 | 11/1981 | Malecha | 414/635 X |
| 4,505,166 | 3/1985 | Tesar | 74/522 X |
| 4,655,672 | 4/1987 | Sinclair et al. | 414/661 |
| 4,794,813 | 1/1989 | Brown et al. | 74/522 X |

FOREIGN PATENT DOCUMENTS

| | | | |
|---|---|---|---|
| 2511383 | 9/1976 | Fed. Rep. of Germany . | |
| 3327848A1 | 2/1985 | Fed. Rep. of Germany . | |
| 3832581A1 | 3/1990 | Fed. Rep. of Germany . | |
| 8014649 | 1/1981 | France . | |
| 50-76570 | 3/1975 | Japan . | |
| 58-84325 | 5/1983 | Japan . | |
| 61-110696 | 7/1986 | Japan . | |
| 491875 | 9/1938 | United Kingdom | 74/525 |

*Primary Examiner*—David A. Bucci

*Attorney, Agent, or Firm*—Brooks Haidt Haffner & Delahunty

[57] ABSTRACT

Control levers for controlling load handling devices are pivotally supported by an eccentric shaft portion of an adjusting shaft. The rotation of the adjusting shaft allows the control levers to move along a circular locus together with the eccentric shaft portion, thereby changing the grip positions of the control levers. Also, the grip positions of a plurality of the control lever can be simultaneously changed.

3 Claims, 5 Drawing Sheets

LOAD HANDLING CONTROL APPARATUS FOR A FORK LIFT TRUCK

FIELD OF THE INVENTION

The present invention relates generally to a load handling control apparatus for a fork lift truck, and more particularly to an improved load handling control apparatus in which the grip position of a control lever can be easily adjusted.

BACKGROUND ART

The load handling functions of a fork lift truck are controlled by a hydraulic system. Fork lift trucks usually have two control levers cooperatively connected to respective control valves in order to supply pressure fluid to a lift cylinder for lifting and lowering a load and to a tilt cylinder for tilting a mast, which are the main functions of a fork lift truck. Also, some fork lift trucks have additional control levers to control the supply of pressure fluid to actuators for various attachments.

FIG. 1 shows an example of a prior load handling control apparatus. A pair of brackets 1*a*, 1*b* are mounted on a truck body, for example on a front protector, and have a support shaft 2 attached therebetween, on which a lift control lever 3*a* and a tilt control lever 3*b* are pivotally supported. The ends of arms 4*a*, 4*b* of the control levers 3*a*, 3*b* are connected to spools 7*a*, 7*b* of a control valve 6 through links 5*a*, 5*b*, respectively. The links 5*a*, 5*b* have adjusting mechanisms such as turnbuckles 9*a*, 9*b* in the middle thereof so as to permit the positions of grips 8*a*, 8*b* of the control levers 3*a*, 3*b* to fit the driver's personal form.

However, adjustments by use of the adjusting mechanisms require tools for handling the adjusting mechanisms. Also, the adjustments require inefficient operations as the control levers must be individually adjusted. Moreover, the time loss from the adjustments is even more severe in a fork lift truck with a number of control levers provided in accordance with the number of attachments as mentioned above, and additionally it is difficult to adjust all the grip positions of the control levers uniformly. Further, it is also possible that the turnbuckles will be loosened by the vibration of the truck body or the like.

SUMMARY OF THE INVENTION

Consequently, the object of the present invention is to provide an improved load handling control apparatus for a fork lift truck in which the grip positions of control levers can be easily adjusted without any special tools.

Another object of the present invention is to provide a load handling control apparatus in which the grip positions of control levers arranged side by side can be simultaneously adjusted.

Another further object of the present invention is to provide a load handling control apparatus in which no deviations in grip positions of control levers will occur due to vibrations of a truck body or the like.

To achieve the above objects, the present invention adopts a novel construction which includes an adjusting shaft having an eccentric shaft portion and supported between a pair of brackets so that the rotational positions of the adjusting shaft can be adjusted, and in which at least one control lever connected to a spool of a control valve through a link is pivotally supported on the eccentric shaft portion.

In accordance with a preferred embodiment of the present invention, means for adjusting rotational positions of the adjusting shaft includes one of the walls of the brackets which support opposite base shaft portions of the adjusting shaft having a plurality of engaging holes disposed therein, the engaging holes surrounding one of the base shaft portions at equal intervals, a knob mounted on an end of the adjusting shaft so as to be axially movable against the urging force of a spring, and at least one positioning pin mounted in the knob and passing through a flange portion around an outer periphery of the end of the adjusting shaft, the positioning pin being adapted to be inserted into and pulled out of the engaging holes in response to the axial movement of the knob.

With this arrangement, when the knob is drawn to pull the positioning pin out of the engaging hole, the restraint of the adjusting shaft can be released. Then, when the adjusting shaft is rotated by turning the knob, the eccentric shaft portion is disposed on a circular locus about an axis of the base shaft portions, and the grip positions of the control levers in neutral states are correspondingly displaced. Thereafter, when the knob is released after the grips are arranged at the desired positions, the positioning pin is inserted into the nearest engaging hole by the spring force and the adjusting shaft is restrained, whereby the control levers are held at the new attitudes.

In this way, the adjustment of the rotational positions of the adjusting shaft can be performed very simply and in a short time without requiring any tools. Also, with a plurality of control levers pivotally supported on the eccentric shaft portion of the adjusting shaft, the attitudes of the control levers can be changed simultaneously without a positional difference between the control levers occurring.

These and other objects and features of the present invention will become apparent from the following detailed explanation in conjunction with the attached drawings.

BRIEF DESCRIPTION OF THE DRAWINGS

In the course of the following detailed description, reference will be made to the attached drawings in which.

DETAILED DESCRIPTION OF THE PREFERRED EMBODIMENT

Figure 1:
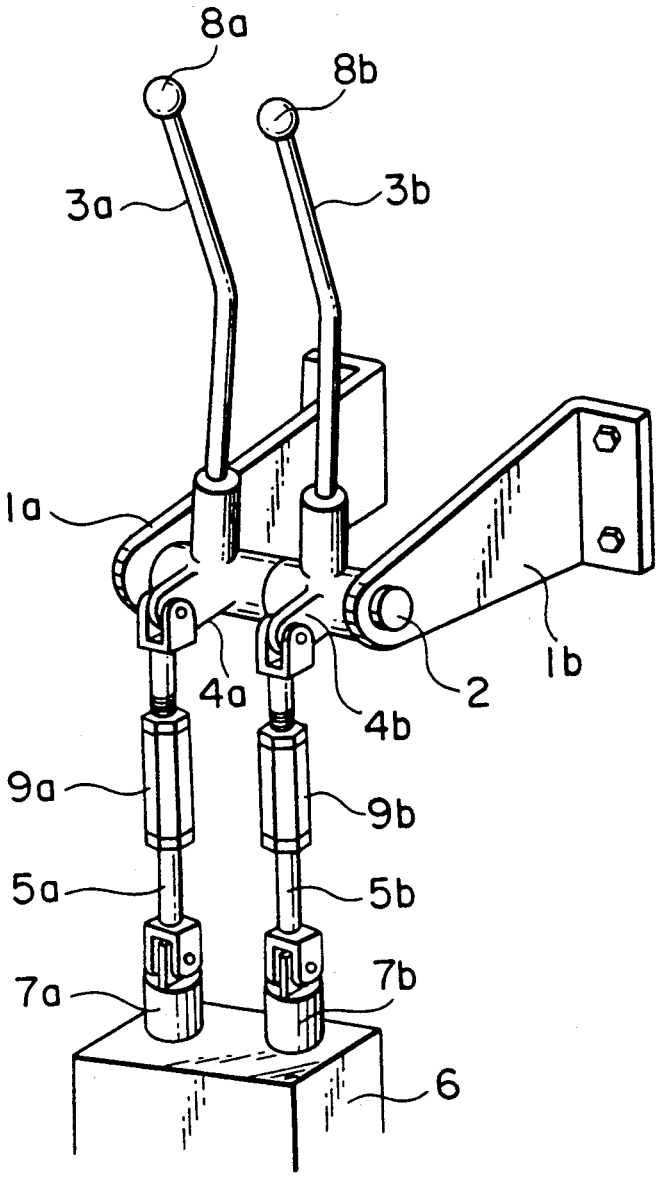
FIG. 1 (PRIOR ART)
FIG. 1 is a perspective view showing a prior load handling control apparatus.
Figure 2:
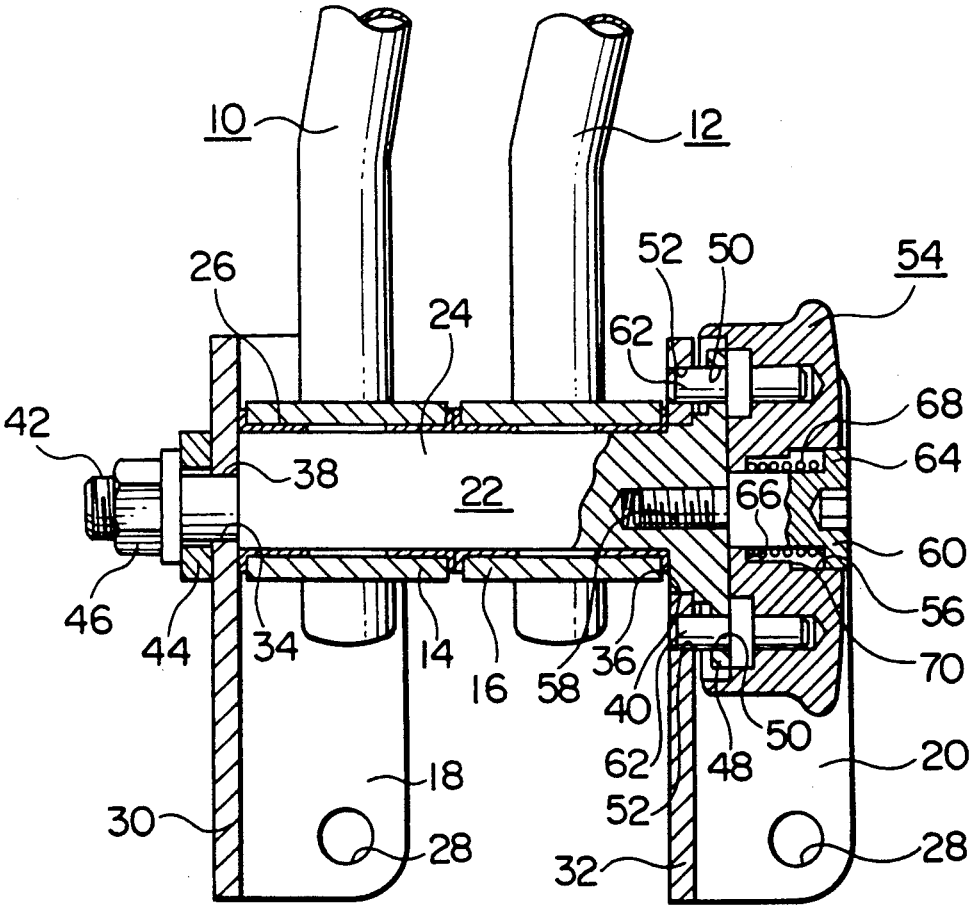
FIG. 2 is a vertical sectional view showing an essential portion of a load handling control apparatus in accordance with the present invention.
Figure 3:
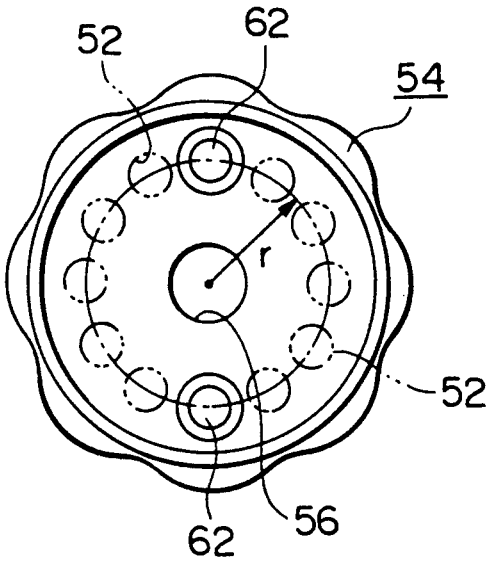
FIG. 3 is a side view showing a knob for rotating an adjusting shaft.
Figure 5:
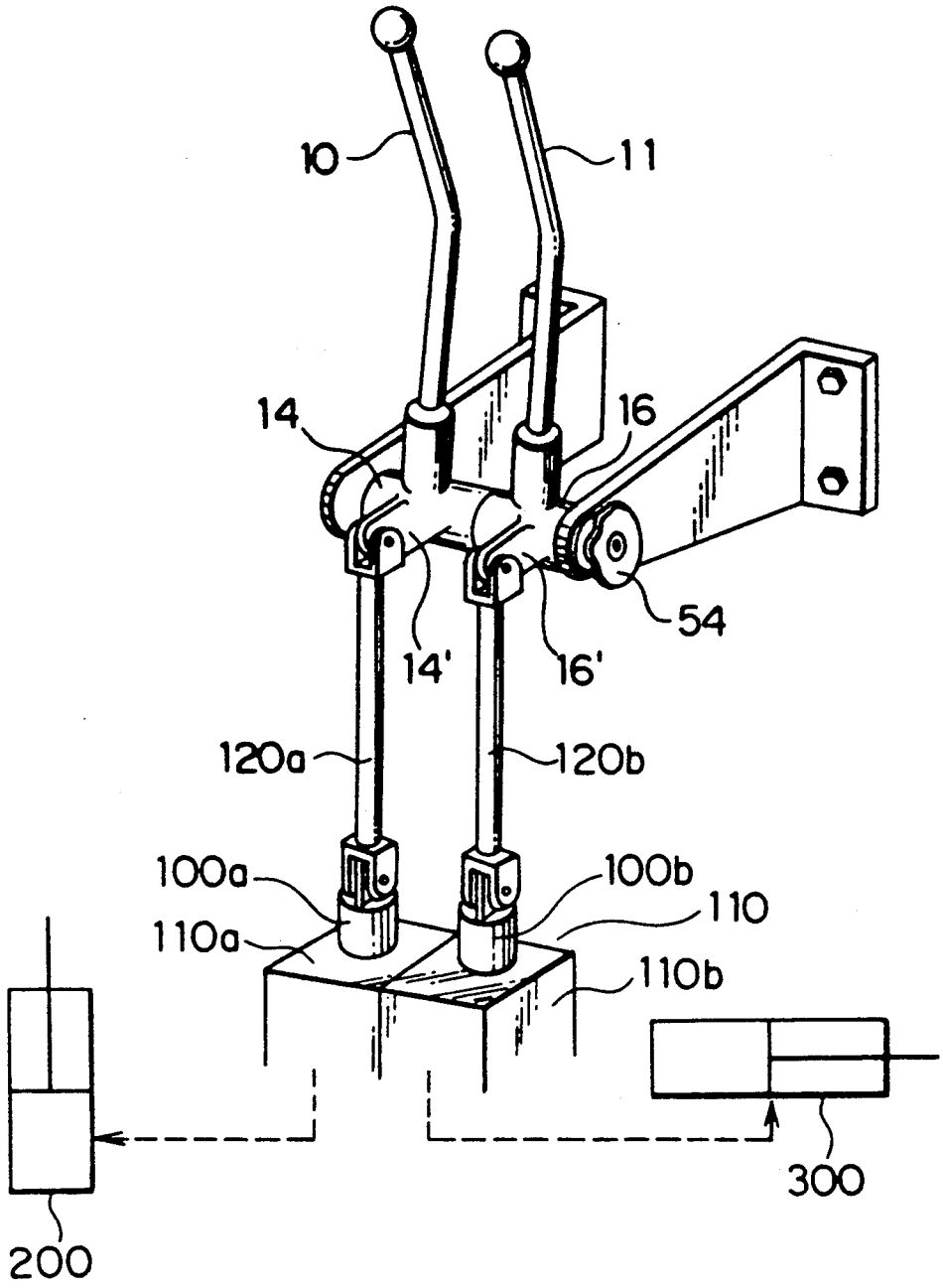
FIG. 5 is a perspective view showing a load handling control apparatus of the present invention.

Referring now to FIGS. 2 and 3, there are shown control levers 10, 12 for controlling a lift cylinder and a tilt cylinder. The control levers 10, 12 have the same shape, and include cylindrical base portions 14, 16 which are juxtaposed and pivotally supported through bushings 26 on an eccentric shaft portion 24 of an adjusting shaft 22 extending between a pair of brackets 18, 20. As shown in FIG. 5, the cylindrical base portions 14, 16 have arms 14', 16' protruding therefrom, and the ends of the arms 14' and 16' are each connected to respective spools 100*a*, 100*b* of control valves 110*a*, 110*b* of a control valve unit 110 through links 120*a*, 120*b*, which is similar to the construction shown in FIG. 1 except for the lack of turnbuckles. As diagrammatically shown in FIG. 5 and as is well known, the control valves 110*a*, 110*b* are hydraulically connected to the lift cylinder 200 and the tilt cylinder 300, respectively. Therefore, when the control levers 10, 12 are tilted, the required quantity of hydraulic fluid is discharged from or supplied to the lift and tilt cylinders 200, 300, respectively.

The brackets 18, 20 are fixed on a fork lift truck body (not shown), for example on a front protector, through mounting holes 28 with suitable fastening means such as bolts. The brackets 18, 20 each have walls 30, 32 extending from a face of the front protector at a right angle and which are opposite and parallel to each other. These opposite walls 30, 32 have fitting holes 34, 36 concentrically disposed therethrough which are of unequal diameters. Base shaft portions 38, 40 on the opposite ends of the adjusting shaft 22 are rotatably supported within the fitting holes 34, 36. Between the base shaft portions 38, 40 is the eccentric shaft portion 24 integrally formed, the axis of which is eccentric to the rotation axis of the base shaft portions 38, 40. The end portion of the one base shaft portion 38 is a threaded portion 42. A spacer 44 is loosely fitted on and a washer based nut 46 is threadably engaged with the threaded portion 42, thereby restraining the axial movement of the adjusting shaft 22. The end of the adjusting shaft beyond the other base shaft portion 40 is provided with a flange portion 48 extending outward. This flange portion 48 has at least one through hole 50 (in the illustrated embodiment, two holes at symmetric positions) arranged on a circle of predetermined radius r from the axis of the base shaft portion 40. Also, the wall 32 of the bracket 20 adjacent to this flange portion 48 has a suitable number of engaging holes (in the illustrated embodiment, twelve holes at equal intervals) drilled therethrough on a circle of the same radius r from the center point of the fitting hole 36, and each engaging hole 52 is identical in diameter to the through hole 50.

A knob 54 is disposed and mounted to be axially movable on the end of the adjusting shaft 22 on the side of the flange portion by a set screw 60 passing through a center hole 56 of the knob 54 and screwed into a threaded hole 58 in the end of the adjusting shaft 22. This knob 54 has a pair of positioning pins 62 which can be inserted into the through holes 50 and the engaging holes 52. Disposed between a flange portion 64 of the set screw 60 and a shoulder portion 66 in the center hole 56 of the knob 54 is a spring 68. Due to the force of this spring 68, the knob 54 normally contacts against the end of the adjusting shaft 22, and at the same time the positioning pins 62 are inserted into the through holes 50 and the engaging holes 52, thereby restraining the rotation of the adjusting shaft 22. When the knob 54 is drawn against the force of the spring 68, it axially moves until the flange portion 64 of the set screw 60 contacts a second shoulder 70 in the center hole 56 of the knob 54 and pulls the positioning pins 62 out of the engaging holes 52. In such a case, the positioning pins 62 are maintained in the through holes 50.

Figure 4:
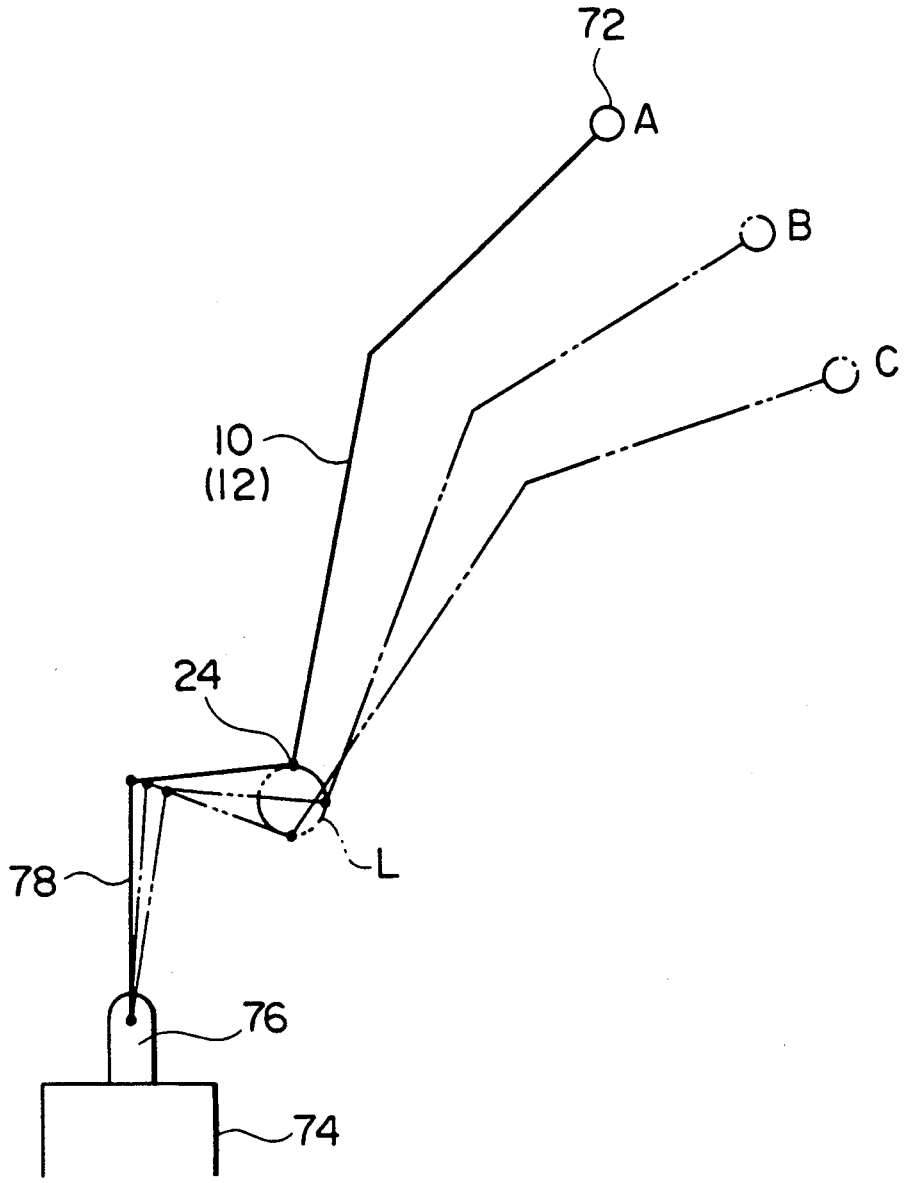
FIG. 4 is an explanatory view showing displacement of a control lever.

Now, the operation for adjusting the attitudes of the control levers for the purpose of displacing the grips thereof will be described by reference also to FIG. 4.

The adjustments are performed while the control levers 10, 12 are in their neutral states. First, the knob 54 is drawn against the urging force of the spring 68 to pull the positioning pins 62 out of the engaging holes 52, thereby releasing the engaging relation between the bracket 20 and the adjusting shaft 22. Subsequently, when the adjusting shaft 22 is rotated with the knob 54, the eccentric shaft portion 24 and the cylindrical base portions 14, 16 of the control levers 10 and 12 supported thereon are both displaced along a circular locus L whose radius is equal to the eccentric distance of the eccentric shaft portion 24, and the positions of the grips 72 of the control levers 10, 12 are also displaced from A to B, and from B to C as shown in FIG. 4. Of course, the links 78 which are interposed between the control levers 10, 12 and the spools 76 of the control valve 74 tilt to follow such displacements of the control levers 10, 12. Then, when the draw of the knob 54 is released in a state where the grips 72 are substantially in the desired positions, the positioning pins 62 are once brought into abutment with outer side surface of the wall 32 of the bracket 20, and thereafter they are inserted into the nearest engaging holes 52 owing to the force of the spring 68 by slightly turning the knob 54. Thus, the adjusting shaft 22 returns to a normal state in which its rotation is restrained, and both the control levers 10 and 12 have their attitudes changed simultaneously, whereby the adjusting operation is completed. Such an operation does not require any particular tools.

Figure 6:
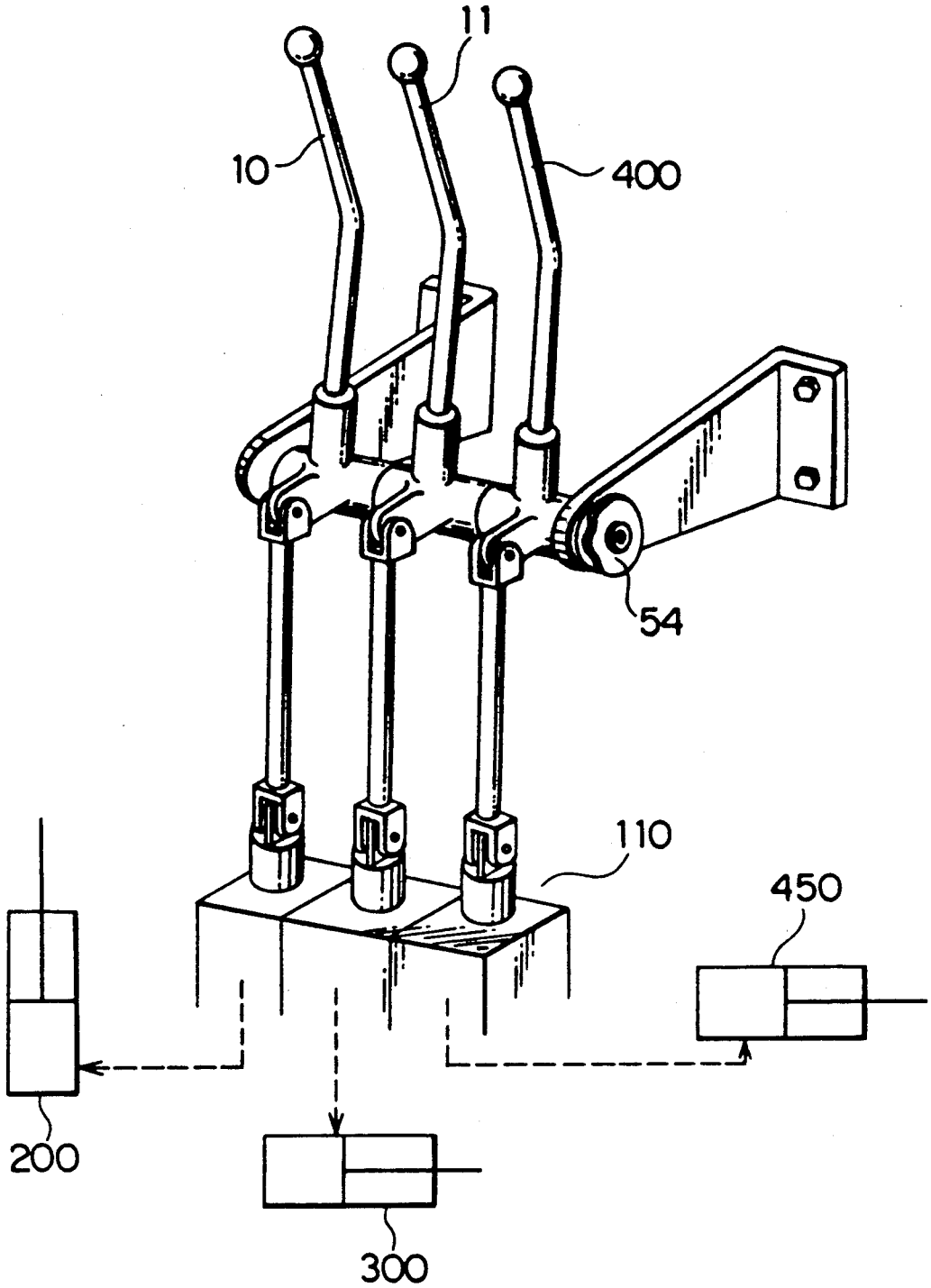
FIG. 6 is a perspective view showing another load handling control apparatus of the present invention.

The load handling control apparatus in accordance with the above embodiment has only two control levers for lifting and tilting. However, the present invention can be adapted to additional control levers for controlling attachments, such as a load clamp. For example, as shown in FIG. 6, if an additional control lever 400 for controlling a cylinder 450 of an attachment is supported on the eccentric shaft portion 24 (see FIG. 2), its grip position can be adjusted along with the other control levers 10, 12.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

What is claimed is:

1. A loading handling control apparatus for a fork lift truck including a pair of brackets mounted on a truck body, an adjusting shaft rotatably supported between said brackets and having an eccentric shaft portion which is eccentric to a rotation axis of said adjusting shaft relative to said brackets and a base shaft portion at both ends of said adjusting shaft respectively, means for adjusting rotational positions of said adjusting shaft, said means including one of said brackets in which a plurality of engaging holes are disposed, said engaging holes surrounding one of said base shaft portions at equal radial distances from the center thereof, a knob mounted on an end of said adjusting shaft so as to be axially movable against the urging force of a spring mounted therein, a flange portion around an outer periphery of said end of the adjusting shaft, and at least one positioning pin mounted in said knob, said positioning pin passing through said flange portion and adapted to be inserted into and pulled out of one of said engaging holes in response to an axial movement of said knob, and at least one control lever for controlling a load handling device which is pivotally supported on said eccentric shaft portion, an arm end of said control lever being cooperatively connected to a spool of a control valve.

2. The load handling control apparatus of claim 1 wherein there are two control levers, one for controlling a lift cylinder and the other for controlling a tilt cylinder.

3. The load handling control apparatus of claim 2 further including a control lever for controlling an attachment.

* * * * *